United States Patent [19]

Sawada

[11] Patent Number: 4,750,328

[45] Date of Patent: Jun. 14, 1988

[54] DOUBLE AIR-FUEL RATIO SENSOR SYSTEM HAVING IMPROVED EXHAUST EMISSION CHARACTERISTICS

[75] Inventor: Hiroshi Sawada, Gotenba, Japan

[73] Assignee: Toyota Jidosha Kabushiki Kaisha, Aichi, Japan

[21] Appl. No.: 105,588

[22] Filed: Oct. 8, 1987

[30] Foreign Application Priority Data

Oct. 13, 1986 [JP] Japan ..... 61-241490

[51] Int. Cl.[4] ..... F02D 41/14

[52] U.S. Cl. ..... 60/274; 60/276; 60/285; 123/489; 123/491

[58] Field of Search ..... 123/440, 489, 589, 491; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72647 | 4/1983 | Japan . |
| 58-72646 | 4/1983 | Japan . |
| 58-135343 | 8/1983 | Japan . |
| 58-150039 | 9/1983 | Japan . |
| 58-150038 | 9/1983 | Japan . |
| 58-152147 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an air-fuel ratio feedback control parameter is calculated in accordance with the output of the downstream-side air-fuel ratio sensor in an air-fuel ratio feedback control mode therefor, and an actual air-fuel ratio is adjusted in accordance with the output of the upstream-side air-fuel ratio sensor and the air-fuel ratio feedback control parameter. In this air-fuel ratio feedback control mode, a large allowable range is imposed on the air-fuel ratio feedback control parameter. In a non air-fuel ratio feed control mode for the downstream-side air-fuel ratio sensor, a small allowable range is imposed on the air-fuel ratio feedback control parameter which, in this case, is unchangeable.

20 Claims, 14 Drawing Sheets

Fig. 2A
Fig. 2B
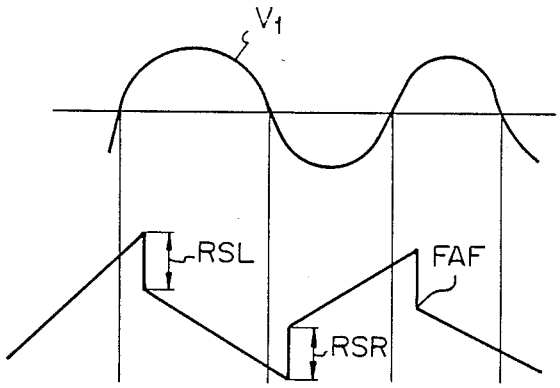
Fig. 9
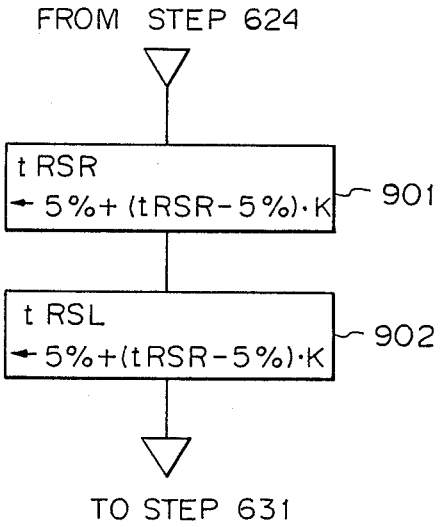

| Fig.4 A | Fig.4 B | Fig.4 C |
|---|---|---|

LEAN
RICH
A/F
TDR
CDLY 0
t1
t2
t3
t4
t5
t6
t7
t8
TDL
A/F'
(F1)

TDR
LEAN
RICH
(-TDL)
TDR

ERSL
KIR
FAF
ERSR
KIL

| Fig.6A | Fig.6B | Fig.6C |
|---|---|---|

DOUBLE AIR-FUEL RATIO SENSOR SYSTEM HAVING IMPROVED EXHAUST EMISSION CHARACTERISTICS

BACKGROUND OF THE INVENTION

1. Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2. Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, for example, an air-fuel ratio feedback control parameter such as a rich skip amount RSR and/or a lean skip amount RSL is calculated in accordance with the output of the downstream-side $O_2$ sensor, and an air-fuel ratio correction amount FAF is calculated in accordance with the output $V_1$ of the upstream-side $O_2$ sensor and the air-fuel ratio feedback control parameter as illustrated in FIGS. 2A and 2B (see: U.S. Ser. Nos. 831,566 and 848,580). In this case, the air-fuel ratio feedback control parameter is stored in a backup random access memory (RAM). Therefore, when the downstream-side $O_2$ sensor is brought to a non-activation state or the like to stop the calculation of the air-fuel ratio feedback control parameter by the downstream-side $O_2$ sensor, the air-fuel ratio correction amount FAF is calculated in accordance with the output of the upstream-side $O_2$ sensor and the air-fuel ratio feedback control parameter which was calculated in an activation state of the downstream-side $O_2$ sensor (i.e., an air-fuel ratio feedback control mode for the downstream-side $O_2$ sensor) and was stored in the backup RAM.

In the above-mentioned double $O_2$ sensor system, however, when the control is transferred from an air-fuel ratio feedback control mode for the downstream-side $O_2$ sensor to an open-loop control mode for the downstream-side $O_2$ sensor, the air-fuel ratio feedback control parameter may be so large or small that an air-fuel ratio feedback control by the upstream-side $O_2$ sensor using the air-fuel ratio feedback control parameter invites overcorrection of the air-fuel ratio. That is, in an air-fuel ratio feedback mode for the upstream-side $O_2$ sensor, when the catalyst converter is not completely activated or when the upstream-side $O_2$ sensor is not completely activated, the air-fuel ratio may be made overrich or overleaned, thus increasing the HC and CO emissions or the $NO_X$ emission. Also, in an air-fuel ratio feedback control mode for the upstream-side $O_2$ sensor, when the engine is in an idling state, the air-fuel ratio may be greatly fluctuated, thus reducing the drivability characteristics. Note that the idling state is usually one condition of the air-fuel ratio feedback control mode for the downstream-side $O_2$ sensor, but is not a condition of the air-fuel ratio feedback control mode for the upstream-side $O_2$ sensor.

Also, in the air-fuel ratio feedback control mode for the upstream-side $O_2$ sensor and in the open-loop control mode for the downstream-side $O_2$ sensor, it is possible to control the actual air-fuel ratio in accordance with the output of the upstream-side $O_2$ sensor and an air-fuel ratio feedback control parameter which is a fixed value. In this case, however, the air-fuel ratio feedback control parameter calculated in the air-fuel ratio feedback mode does not reflect the control of the air-fuel ratio in the open-loop control mode for the downstream-side $O_2$ sensor at all, and accordingly, it is impossible to obtain an optimum air-fuel ratio such as the stoichiometric air-fuel ratio in the open-loop control mode.

SUMMARY OF THE INVENTION

It is an object of the present invention to provide a double air-fuel ratio sensor system having improved exhaust emission characteristics and having improved drivability characteristics in an air-fuel ratio feedback control mode for an upstream-side air-fuel ratio sensor, but in an open-loop control mode for a downstream-side air-fuel ratio sensor.

According to the present invention, in an air-fuel ratio feedback control mode for the downstream-side air-fuel ratio sensor which, in this case, includes an air-fuel ratio feedback control mode for the upstream-side air-fuel ratio sensor, an air-fuel ratio feedback control parameter is calculated in accordance with the output of the downstream-side air-fuel ratio sensor, and an actual air-fuel ratio is adjusted in accordance with the output of the upstream-side air-fuel ratio sensor and the air-fuel ratio feedback control parameter. In this air-fuel ratio feedback control mode, a large allowable range is imposed on the air-fuel ratio feedback control parameter, and in a non air-fuel ratio feed control mode for the downstream-side air-fuel ratio sensor, a small allowable range is imposed on the air-fuel ratio feedback control parameter which is, in this case, unchangeable.

As a result, since the allowable range of the air-fuel ratio feedback control parameter is large in the air-fuel ratio feedback mode for the downstream-side $O_2$ sensor, effective use is made of a double air-fuel ratio sensor system is effectively made use of. On the other hand, in the open-loop control mode for the downstream-side $O_2$ sensor 15, and in the air-fuel ratio feedback control mode for the upstream-side $O_2$ sensor 13, since the allowable range of the air-fuel ratio feedback control parameter is small, the deviation of the air-fuel ratio from the stoichiometric air-fuel ratio is small, thus improving the HC, CO, and $NO_X$ emission characteristics, the drivability characteristics, and the fuel consumption.

BRIEF DESCRIPTION OF THE DRAWINGS

The present invention will be more clearly understood from the description as set forth below with reference to the accompanying drawings, wherein:

FIGS. 2A and 2B are timing diagrams explaining an example of a double $O_2$ sensor system;

FIGS. 4, 4A–4C, 6, 6A–6C, 7, 9, 10, 11, and 12 are flow charts showing the operation of the control circuit of FIG. 3;

DESCRIPTION OF THE PREFERRED EMBODIMENTS

Figure 1:
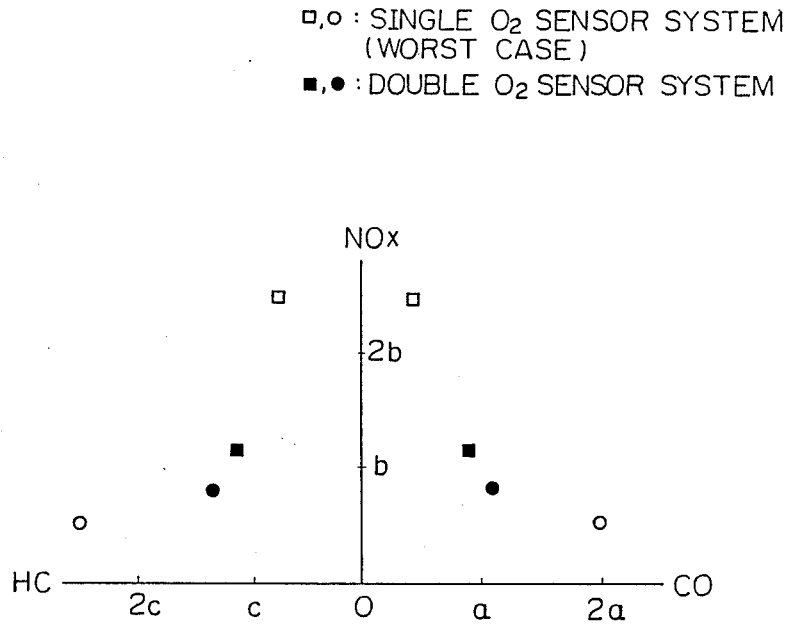
FIG. 1 is a graph showing the emission characteristics of a single $O_2$ sensor system and a double $O_2$ sensor system.
Figure 3:
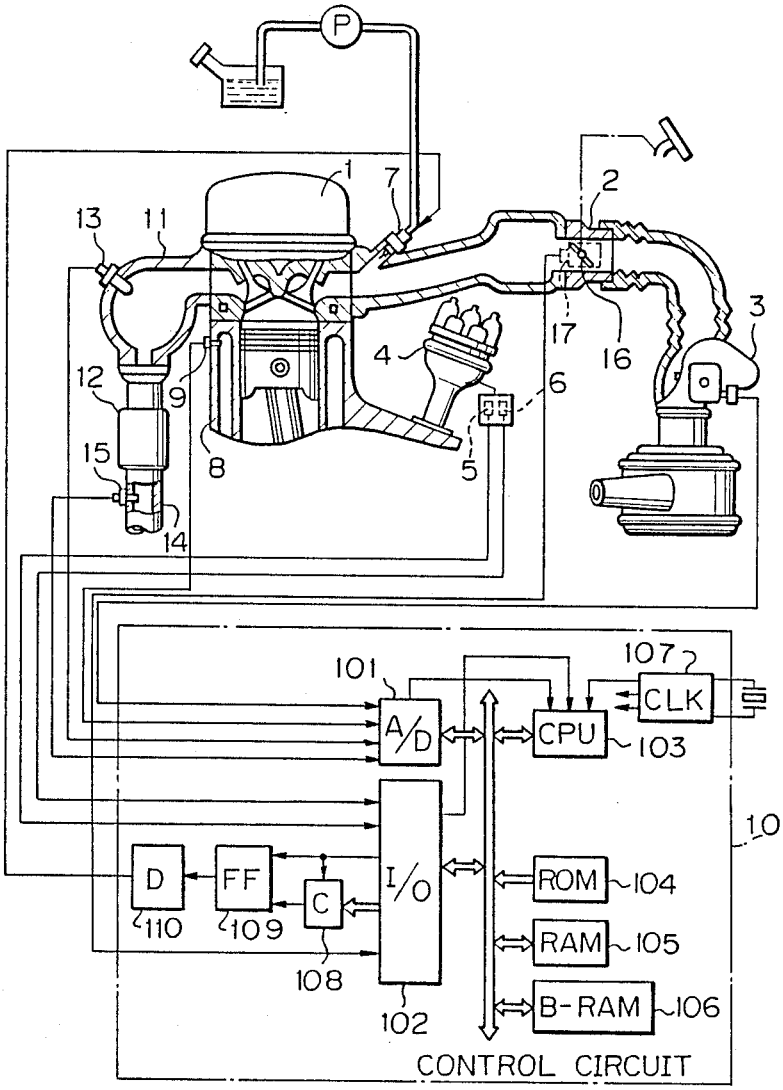
FIG. 3 is a schematic view of an internal combustion engined according to the present invention.

In FIG. 3, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crank-shaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 3.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 3 will be now explained.

Figures 4, 4A:
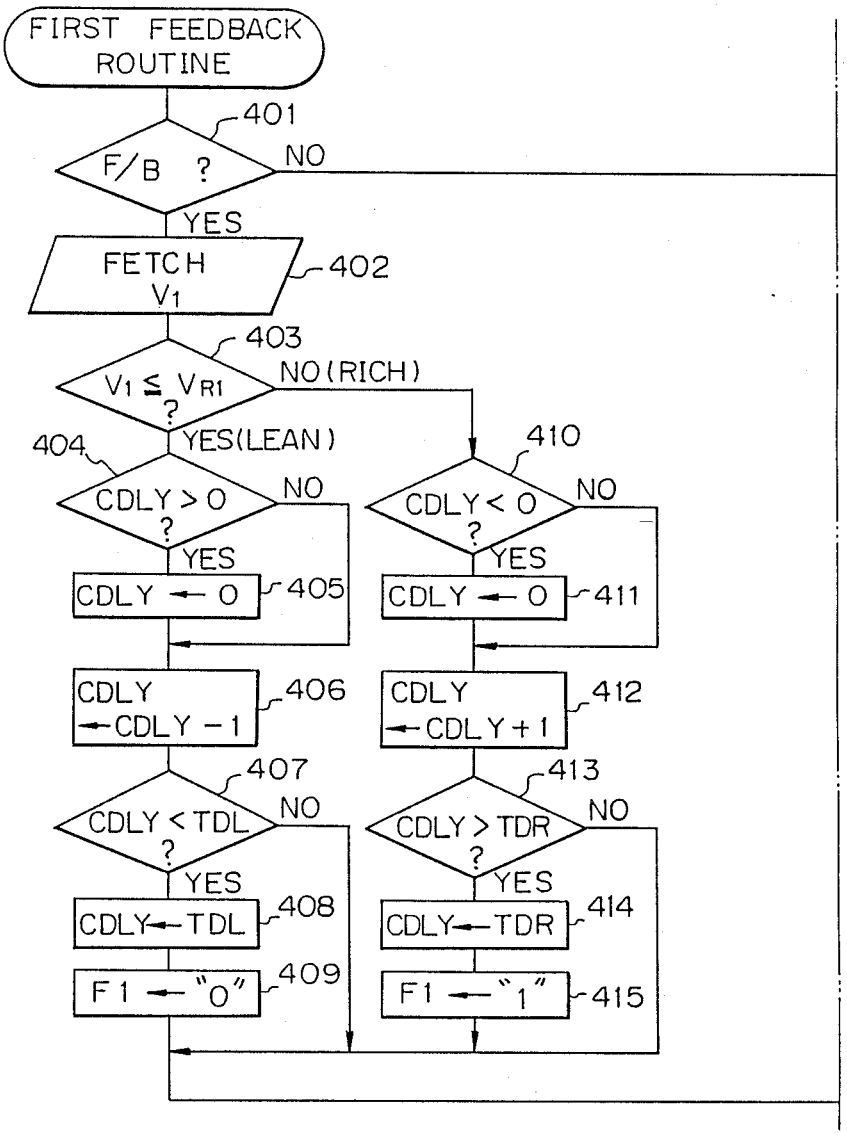
Figure 4B:
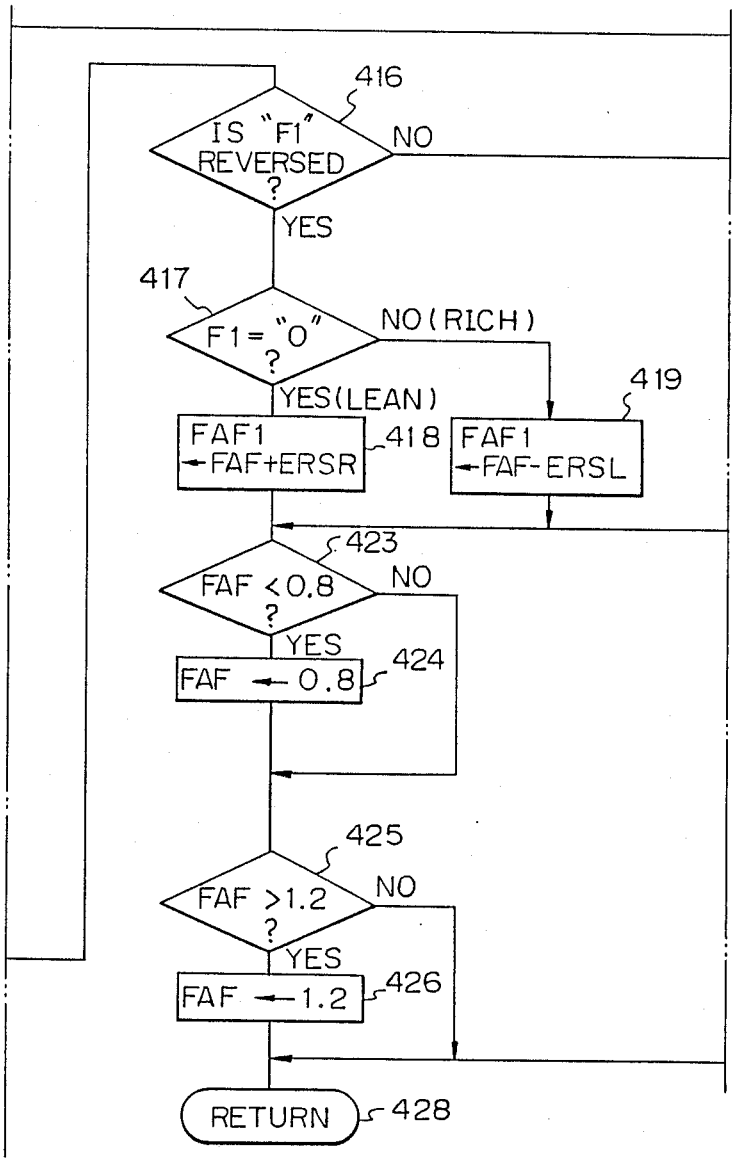
Figure 4C:
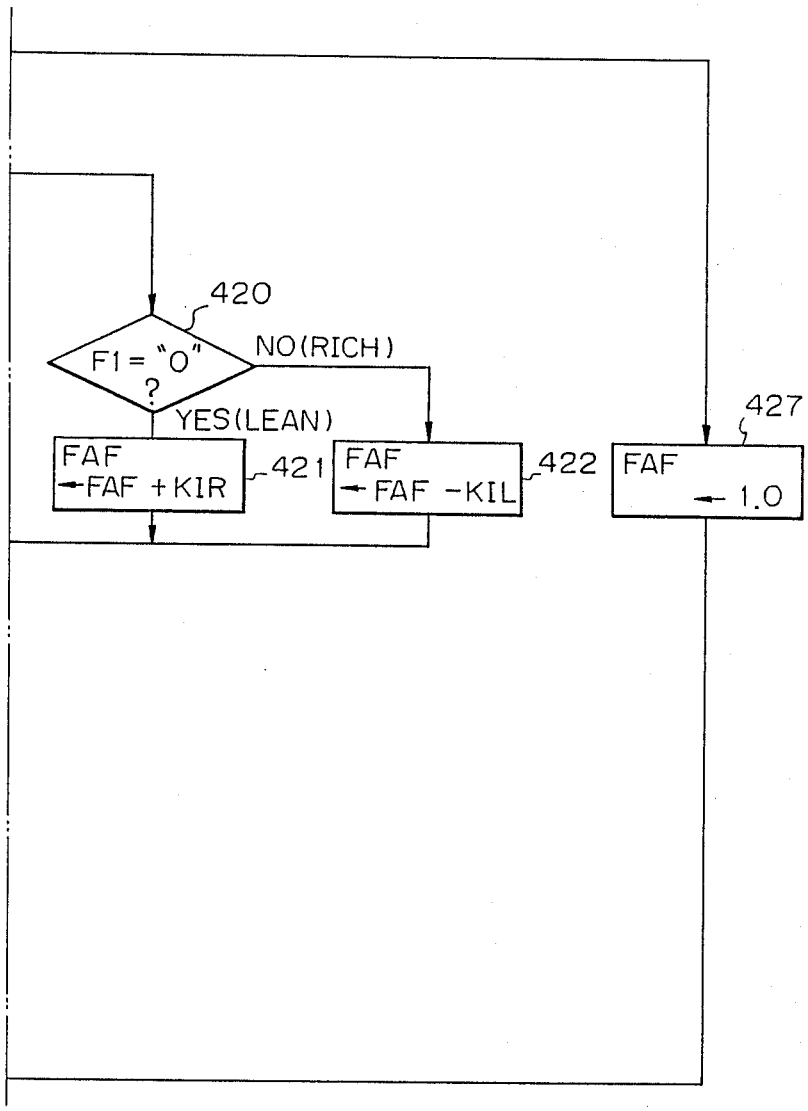

FIG. 4 is a routine for calculating a first air-fuel ratio feedback correction amount FAF1 in accordance with output of the upstream-side $O_2$ sensor 13 executed at every predetermined time period such as 4 ms.

At step 401, it is determined whether or not all of the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 428, in which the amount FAF is caused to be 1.0 (FAF=1.0), thereby carrying out an open-loop control operation. Note that, in this case, the amount FAF can be a value or a mean value immediately before the open-loop control operation. That is, the amount FAF or a mean value FAF thereof is stored in the backup RAM 106, and in an open-loop control operation, the value FAF or FAF is read out of the backup RAM 106.

Contrary to the above, at step 401, if all of the feedback control conditions are satisfied, the control proceeds the step 402.

At step 402, an A/D conversion is performed upon the output voltage $V_1$ of the upstream-side $O_2$ sensor 13, and the A/D converted value thereof is then fetched from the A/D converter 101. Then at step 403, the voltage V1 is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio upstream of the catalyst converter 12 is lean, the control proceeds to step 404, which determines whether or not the value of a delay counter CDLY is positive. If CDLY>0, the control proceeds to step 405, which clears the delay counter CDLY, and then proceeds to step 406. If CDLY≦0, the control proceeds directly to step 406. At step 406, the delay counter CDLY is counted down by 1, and at step 407, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 407, only when CDLY<TDL does the control proceed to step 408, which causes CDLY to be TDL, and then to step 409, which causes a first air-fuel ratio flag F1 to be "0" (lean state). On the other hand, if $V_1 > V_{R1}$, which means that the current air-fuel ratio upstream of the catalyst converter 12 is rich, the control proceeds to step 410, which determines whether or not the value of the delay counter CDLY is negative. If CDLY<0, the control proceeds to step 411, which clears the delay counter CDLY, and then proceeds to step 412. If CDLY ≧0, the control directly proceeds to 412. At step 412, the delay counter CDLY is counted up by 1, and at step 413, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 413, only when CDLY>TDR does the control proceed to step 414, which causes CDLY to the TDR, and then to step 415, which causes the first air-fuel ratio flag F1 to be "1" (rich state).

Next, at step 416, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 417 to 419, which carry out a skip operation.

At step 417, if the flag F1 is "0" (lean) the control proceeds to step 418, which remarkably increases the correction amount FAF by an effective skip amount ERSR. Also, if the flag F1 is "1" (rich) at step 417, the control proceeds to step 419, which remarkably decreases the correction amount FAF by an effective skip amount ERSL. Note that the effective skip amounts ERSR and ERSL are calculated by the routine of FIG. 6 and are stored in the RAM 105.

On the other hand, if the first air-fuel ratio flag F1 is not reversed at step 416, the control proceeds to steps 420 to 422, which carries out an integration operation. That is, if the flag F1 is "0" (lean) at step 420, the control proceeds to step 421, which gradually increases the correction amount FAF by a rich integration amount KIR. Also, if the flag F1 is "1" (rich) at step 420, the control proceeds to step 422, which gradually decreases the correction amount FAF by a lean integration amount KIL. Note that, in this case, KIR (KIL)<-ERSR (ERSL).

The correction amount FAF is guarded by a minimum value 0.8 at steps 423 and 424. Also the correction amount FAF is guarded by a maximum value 1.2 at steps 425 and 426. Thus, the controlled air-fuel ratio is prevented from becoming overlean or overrich.

The correction amount FAF is then stored in the RAM 105, thus completing this routine of FIG. 4 at steps 428.

Figures 5A, 5B, 5C, 5D:
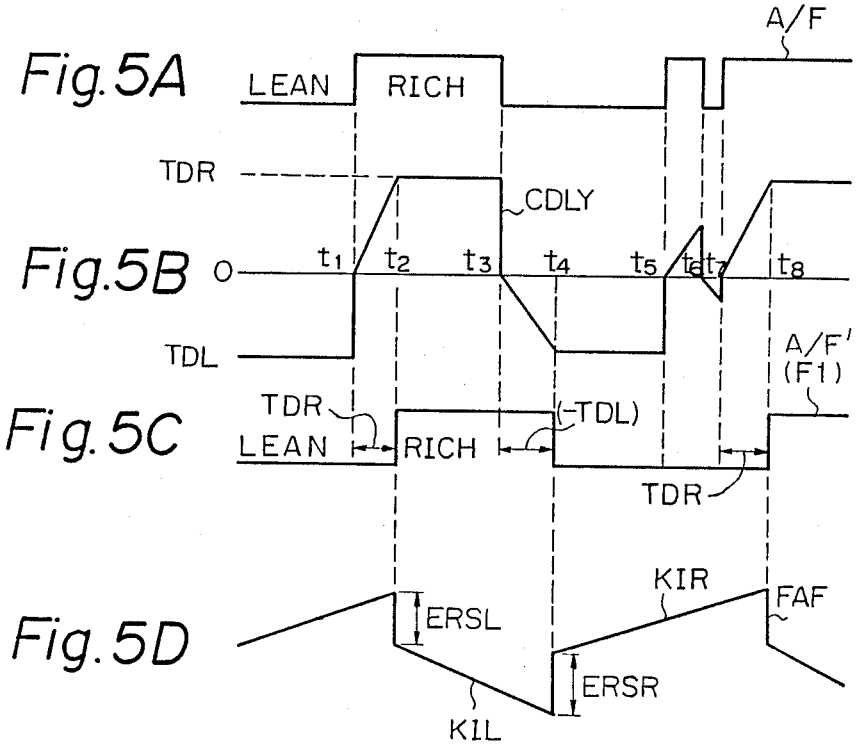
FIGS. 5A through 5D are timing diagrams explaining the flow chart of FIG. 4.

The operation by the flow chart of FIG. 4 will be further explained with reference to FIGS. 5A through 5D. As illustrated in FIG. 5A, when the air-fuel ratio A/F is obtained by the output of the upstream-side $O_2$ sensor 13, the delay counter CDLY is counted up during a rich state, and is counted down during a lean state, as illustrated in FIG. 5B. As a result, a delayed air-fuel ratio corresponding to the first air-fuel ratio flag F1 is obtained as illustrated in FIG. 5C. For example, at time $t_1$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air-fuel ratio F1 is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F' is reversed at time $t_8$. That is, the delayed air-fuel ratio A/F' is stable when compared with the air-fuel ratio A/F. Further, as illustrated in FIG. 4D, at every change of the delayed air-fuel ratio A/F' from the rich side to the lean side, or vice versa, the correction amount FAF is skipped by the skip amount ERSR or ERSL, and in addition, the correction amount FAF is gradually increased or decreased in accordance with the delayed air-fuel ratio A/F'.

Air-fuel ratio feedback control operations by the downstream-side $O_2$ sensor 15 will be explained. There is a type of air-fuel ratio feedback control operations by the downstream-side $O_2$ sensor 15 in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes longer than the lean delay time period (TDR>(−TDL)), the controlled air-fuel becomes richer, and if the lean delay time period becomes longer than the rich delay time period ((−TDL)>TDR), the controlled air-fuel ratio becomes leaner. Thus, the air-fuel ratio can be controlled by changing the rich delay time period TDR and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits obtained by the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system, in which an air-fuel ratio feedback control parameter of the first air-fuel ratio feedback control by the upstream-side $O_2$ sensor is variable, will be explained with reference to FIGS. 6 and 7. In this case, the skip amounts RSR and RSL as the air-fuel ratio feedback control parameters are variable.

Figures 6, 6A:
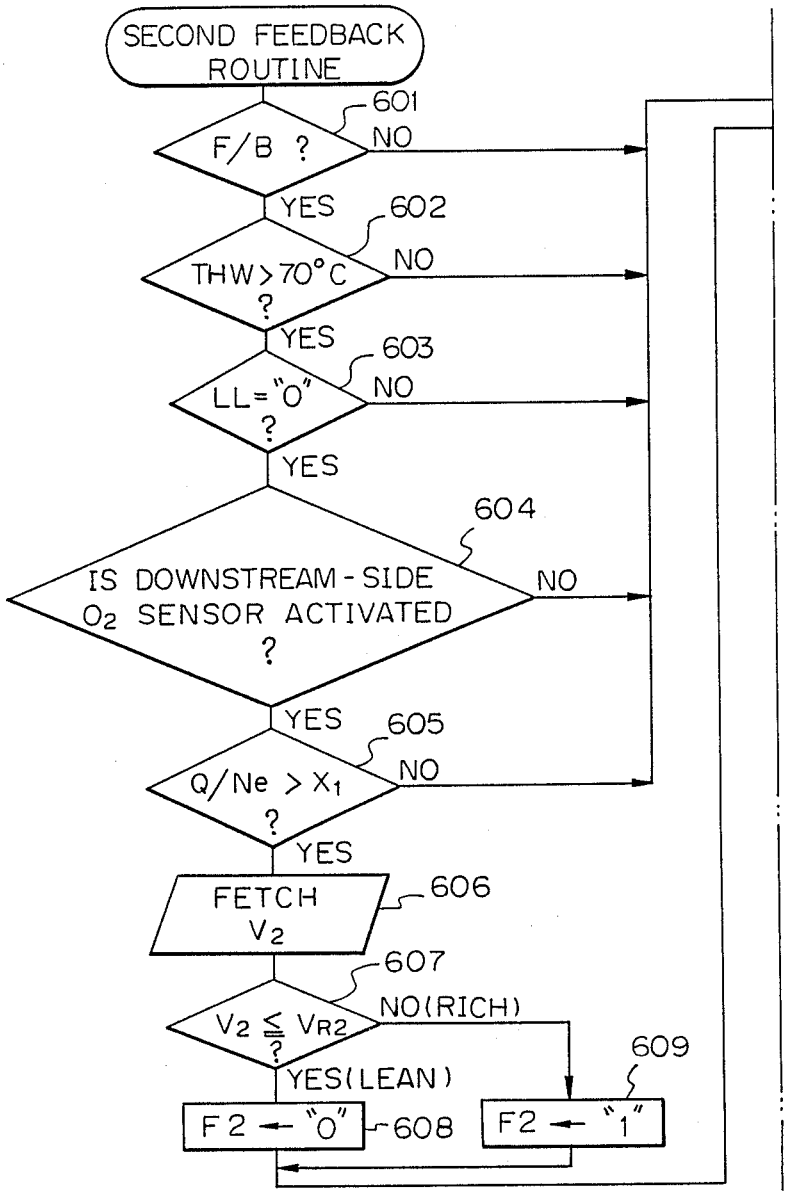
Figure 6B:
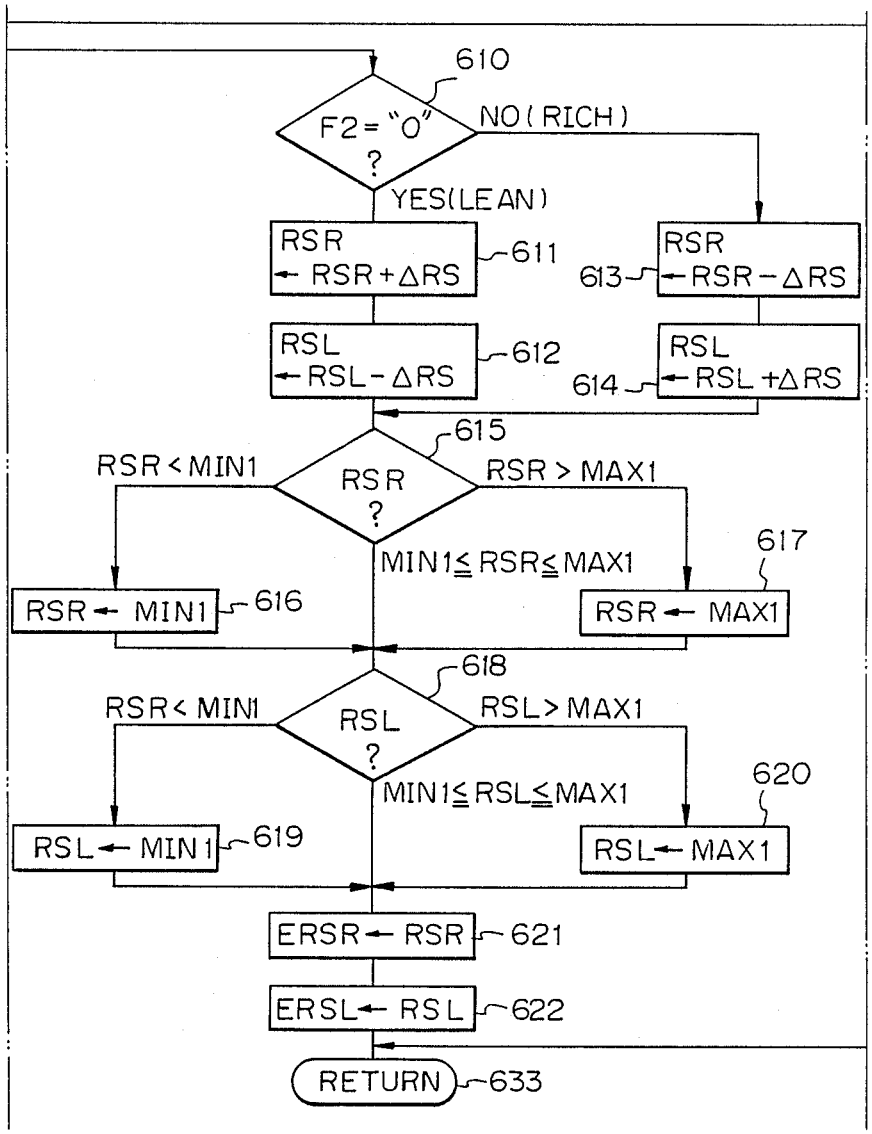
Figure 6C:
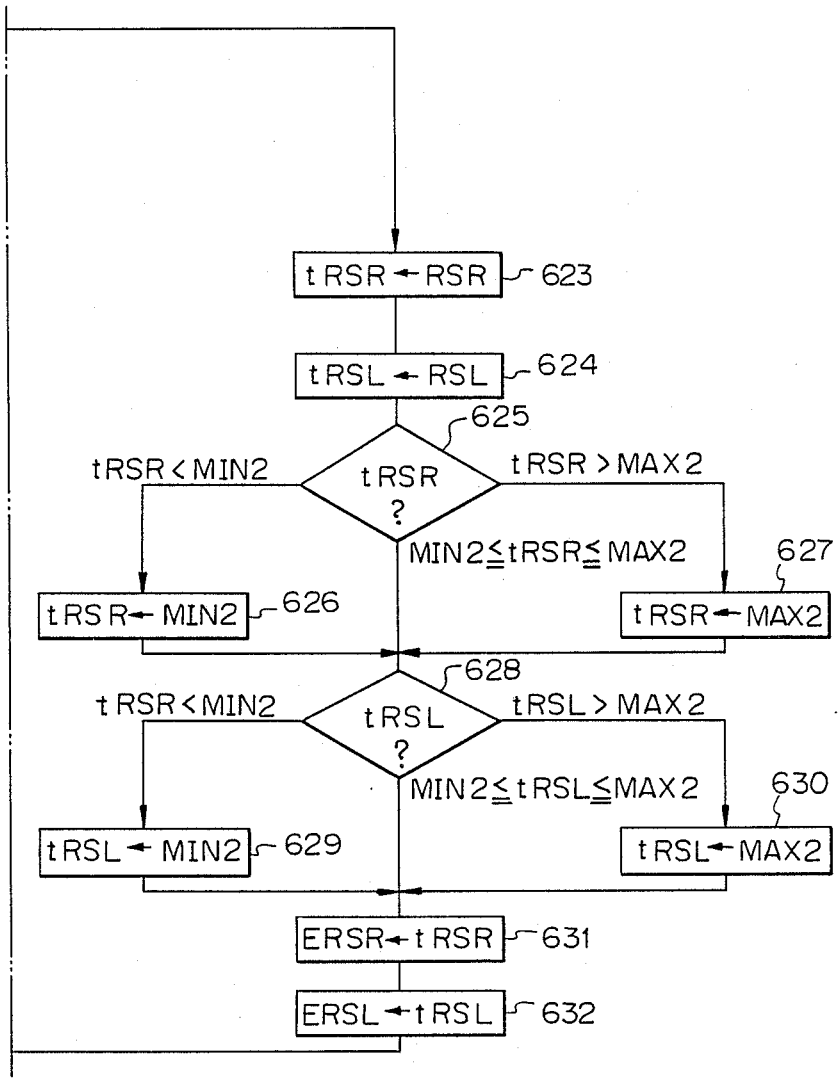

FIG. 6 is a routine for calculating the effective skip amounts ERSR and ERSL in accordance with the output $V_2$ of the downstream-side $O_2$ sensor 15 executed at every predetermined time period such as 1 s.

At steps 601 through 605, it is determined whether or not all of the feedback control (closed-loop control) conditions by the downstream-side $O_2$ sensor 15 are satisfied. For example, at step 601, it is determined whether or not the feedback control conditions by the upstream-side $O_2$ sensor 13 are satisfied. At step 602, it is determined whether or not the coolant temperature THW is higher than 70° C. At step 603, it is determined whether or not the throttle valve 16 is open (LL="0"). At step 604, it is determined whether or not the output $V_2$ of the downstream-side $O_2$ sensor 15 has been once changed from the lean side to the rich side or vice versa. At step 605, it is determined whether or not a load parameter such as Q/Ne is larger than a predetermined value $X_1$. Of course, other feedback control conditions are introduced as occasion demands. However, an explanation of such other feedback control conditions is omitted.

If one or more of the feedback control conditions is not satisfied, the control proceeds directly to step 623, thereby carrying out an open-loop control operation.

Contrary to the above, if all of the feedback control conditions are satisfied, the control proceeds to step 606. At step 606, an A/D conversion is performed upon the output voltage $V_2$ of the downstream-side $O_2$ sensor 15, and the A/D converted value thereof is then fetched from the A/D converter 101. Then, at step 607, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 607, if the air-fuel ratio is lean, the control proceeds to step 608 which resets a second air-fuel ratio flag F2. Alternatively, the control proceeds the step 609, which sets the second air-fuel ratio flag F2.

At step 610, it is determined whether or not the second air-fuel ratio F2 is "0". If F2="0", which means that the air-fuel ratio downstream of the catalyst converter 12 is lean, the control proceeds to steps 611 and 612, and if F2="1", which means that the air-fuel ratio downstream of the catalyst converter 12 is rich, the control proceeds to steps 613 and 614.

At step 611, a rich skip amount RSR is read out of the backup RAM 106, and, the rich skip amount RSR is increased by a definite value ΔRS such as 0.08% to move the air-fuel ratio to the rich side. Further, at step 612, a lean skip amount RSL is read out of the backup RAM 106, and the lean skip amount RSL is decreased by the definite value ΔRS to move the air-fuel ratio to the rich side.

On the other hand, at step 613, the rich skip amount RSR is read out of the backup RAM 106, and, the rich skip amount RSR is decreased by a definite value ΔRS to move the air-fuel ratio to the lean side. Further, at step 614, the lean skip amount RSL is read out of the backup RAM 106, and the lean skip amount RSL is increased by the definite value ΔRS to move the air-fuel ratio to the lean side.

The skip amounts RSR and RSL are guarded by an allowable range defined by a minimum value MIN1 and a maximum value MAX1 at steps 615 through 620. In this case, in order to effectively make use of a double $O_2$ sensor system, this allowable range is larger. For example, the values MIN1 and MAX1 are 0% and 10%, respectively, and therefore, the allowable range is 0% to 10% (5%±5%). That is, at step 615, it is determined whether or not the rich skip amount RSR is within a range of MIN1 to MAX1. As a result, if RSR<MIN1, the control proceeds to step 616 which causes RSR to be MIN1, and if RSR>MAX1, the control proceeds to step 617 which causes RSR to be MAX1. Similarly, at step 618, it is determined whether or not the rich skip amount RSL is within the range of MIN1 to MAX1. As a result, if RSL<MIN1, the control proceeds to step 619 which causes RSL to be MIN1, and if RSL>MAX1, the control proceeds to step 620 which causes RSL to be MAX1.

Next, at step 621, the effective rich skip amount ERSR is replaced by the rich skip amount RSR, and at step 622, the effective lean skip amount ERSL is replaced by the lean skip amount RSL. That is,

ERSR←RSR

ERSL←RSL

Note that the skip amounts RSR and RSL are stored in the backup RAM 106, while the effective skip amounts ERSR and ERSL are stored in the RAM 105. Also, the minimum value MIN1 is a level by which the transient characteristics of the skip operation using the amounts RSR and RSL can be maintained, and the maximum value MAX1 is a level by which the drivability is not deteriorated by the fluctuation of the air-fuel ratio.

Steps 623 through 632 for the open-loop control will be explained. At step 623, the rich skip amount RSR is read out of the backup RAM 106, and a rich skip amount tRSR for an open-loop control is replaced by the rich skip amount RSR. Further, at step 624, the lean skip amount RSL is read out of the backup RAM 106, and a lean skip amount tRSL for an open-loop control is replaced by the lean skip amount RSL. That is, the skip amounts tRSR and tRSL for an open-loop control are the values of the skip amounts RSR and RSL for an air-fuel ratio feedback control immediately before an open-loop control is initiated.

The skip amounts tRSR and tRSL for an open-loop control are guarded by an allowable range defined by a minimum value MIN2 and a maximum value MAX2 at steps 625 through 630. In this case, in order to reduce the fluctuation of the air-fuel ratio by the air-fuel ratio feedback control of the output $V_1$ of the upstream-side $O_2$ sensor 13 in an open-loop control mode of the downstream-side $O_2$ sensor 15, this allowable range is smaller as compared with the allowable range of MIN1 to MAX1. For example, the values MIN2 and MAX2 are 2% and 8%, respectively, and therefore, this allowable range is 2% to 8% (5%±3%). That is, at step 625, it is determined whether or not the rich skip amount tRSR is within a range of MIN2 to MAX2. As a result, if tRSR<MIN2, the control proceeds to step 626 which causes tRSR to be MIN2, and if tRSR>MAX2, the control proceeds to step 627 which causes tRSR to be MAX2. Similarly, at step 628, it is determined whether or not the rich skip amount tRSL is within the range of MIN2 to MAX2. As a result, if tRSL<MIN2, the control proceeds to step 629 which causes tRSL to be MIN2, and if tRSL>MAX1, the control proceeds to step 630 which causes tRSL to be MAX2.

Next, at step 631, the effective rich skip amount ERSR is replaced by the rich skip amount tRSR, and at step 632, the effective lean skip amount ERSL is replaced by the lean skip amount tRSL. That is, ERSR←tRSR ERSL←tRSL.

Note that the skip amounts tRSR and tRSL are stored in the RAM 105.

The routine of FIG. 6 is completed by step 633.

Figure 7:
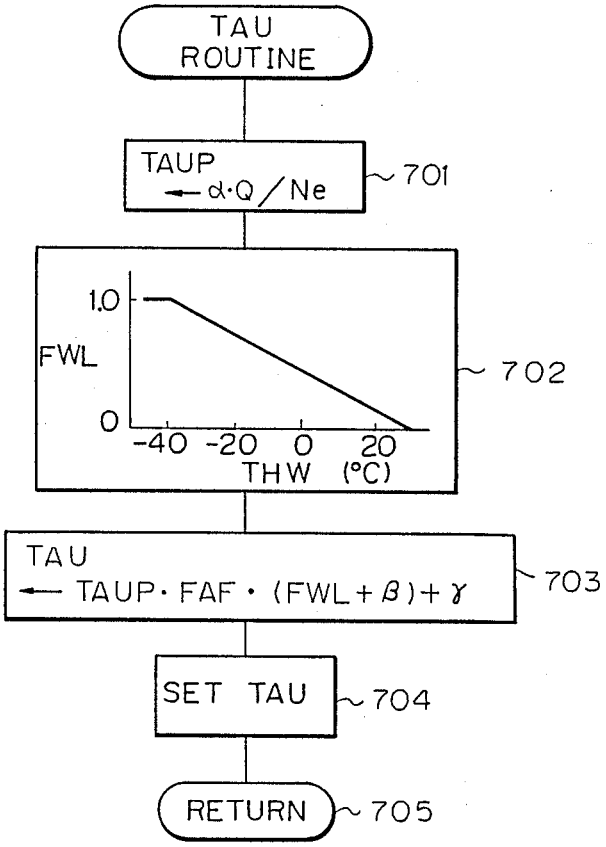

FIG. 7 is a routine for calculating a fuel injection amount TAU executed at every predetermined crank angle such as 360° CA. At step 701, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 702, a warming-up incremental amount FWL is calculated from a one-dimensional map by using the coolant temperature data THW stored in the RAM 105. Note that the warming-up incremental amount FWL decreased when the coolant temperature THW increases. At step 803, a final fuel injectional amount TAU is calculated by $$TAU \leftarrow TAUP \cdot FAF \cdot (FWL + \beta) + \gamma$$

where $\beta$ and $\beta$ are correction factors determined by other parameters such as the voltage of the battery and the temperature of the intake air. At step 704, the final fuel injection amount TAU is set in the down counter 108, and in addition, the flip-flop 109 is set to initiate the activation of the fuel injection valve 7. This routine is then completed by step 705. Note that, as explained above, when a time period corresponding to the amount TAU has passed, the flip-flop 109 is reset by the carry-out signal of the down counter 108 to stop the activation of the fuel injection valve 7.

Figures 8A, 8B, 8C, 8D:
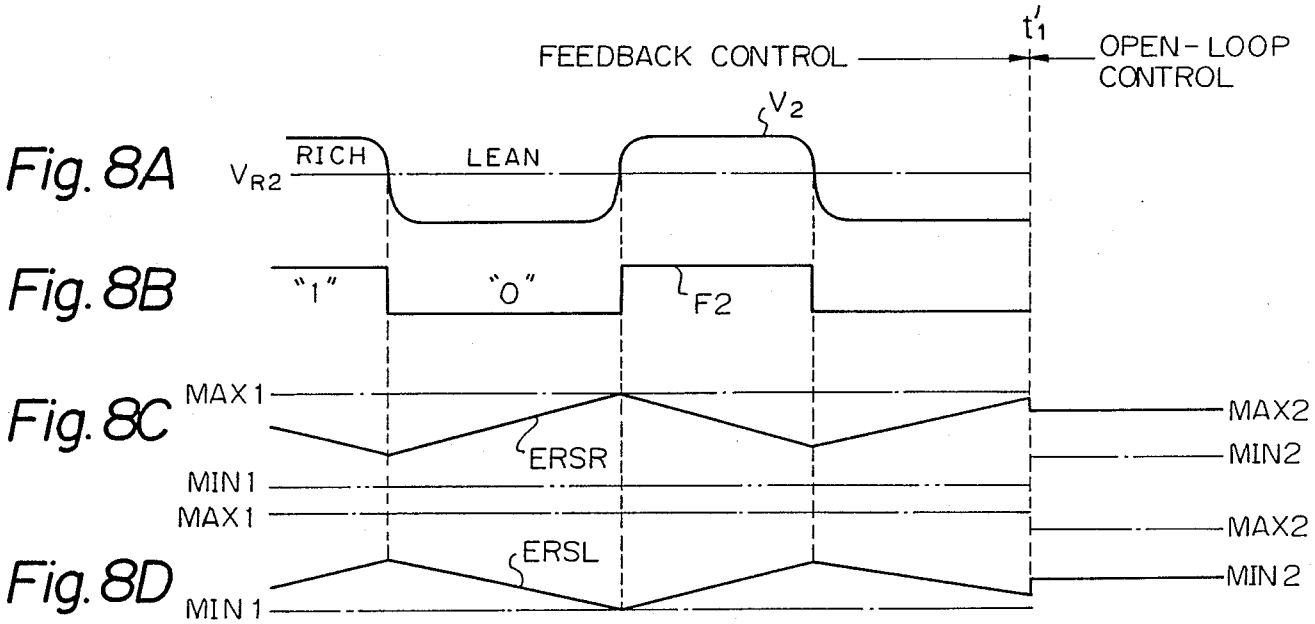
FIGS. 8A through 8D are timing diagrams explaining the flow charts of FIG. 6.

FIGS. 8A through 8D are timing diagrams for explaining the effective skip amounts ERSR and ERSL obtained by the flow charts of FIG. 6. In this case, before time $t_1'$, the engine is in an air-fuel ratio feedback control mode for the downstream-side $O_2$ sensor 15, and after time $t_1'$, the engine is in an open-loop control mode for the downstream-side $O_2$ sensor 15. In the air-fuel ratio feedback control mode, when the output of the downstream-side $O_2$ sensor 15 is changed as illustrated in FIG. 8A, the determination at 610 of FIG. 6 corresponding to the second air-fuel ratio flag F2 is shown in FIG. 8B. As a result, as shown in FIGS. 8C and 8D, when the determination at step 610 is lean, the effective rich skip amount ERSR is gradually increased at the speed of ΔRS and the effective lean skip amount ERSL is gradually decreased at the speed of ΔRS, and when the determination at step 610 is rich, the effective rich skip amount ERSR is gradually decreased at the speed of ΔRS and the effective lean skip amount ERSL is gradually increased at the speed of ΔRS. In this case, the effective skip amounts RSR and RSL are changed within a range of from MAX1 to MIN1. On the other hand, in the open-loop control mode, the effective skip amounts ERSR and ERSL calculated in the air-fuel ratio feedback control mode are held, but in this case, the held values are kept to be within a range of from MIN2 to MAX2.

In FIG. 9, which is a modification of FIG. 6, steps 901 and 902 are provided instead of steps 625 through 630 of FIG. 6, thereby reducing the controlled range (i.e., the amplitude)Δ(=ERSR−ERSL ) of the effective skip amounts ERSR and ERSL before the open-loop control by a definite ratio K (<1). That is, if the control center of the effective skip amounts is defined by ERSR=ERSL=5%, at step 901, $$tRSR \leftarrow 5\% + (tRSR - 5\%) \cdot K.$$

Also, at step 902, $$tRSL \leftarrow 5\% + (tRSL - 5\%) \cdot K.$$

In this case, in view of the software efficiency, the value K is preferably ½ (1 bit shift operation) or 0.75 (=½+¼) in accordance with a driving parameter. According to the routine of FIG. 9, the control range Δ (=ERSR−ERSL ) is reduced by K in an open-loop control mode as compared with in an open-loop control mode. Also, if the controlled range Δ is already small immediately before the open-loop control, the controlled range Δ is further reduced in the open-loop control.

Figure 10:
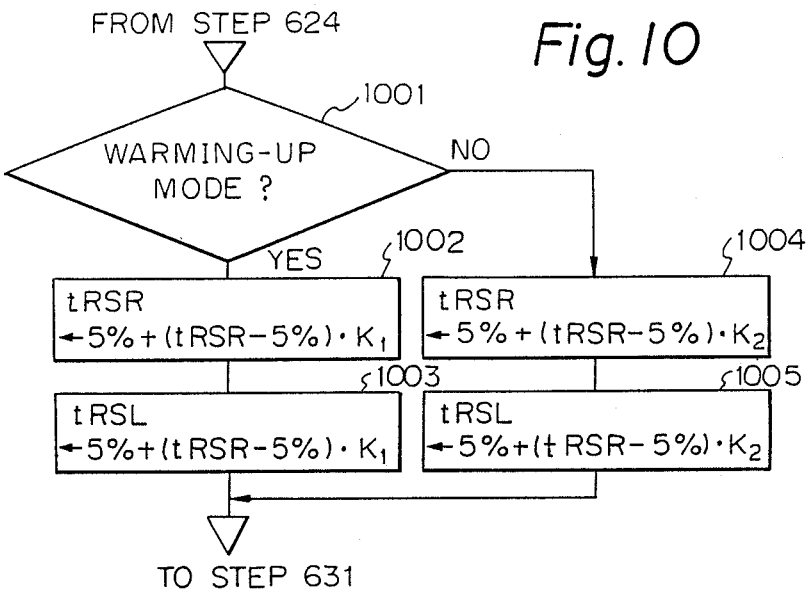
Figure 12:
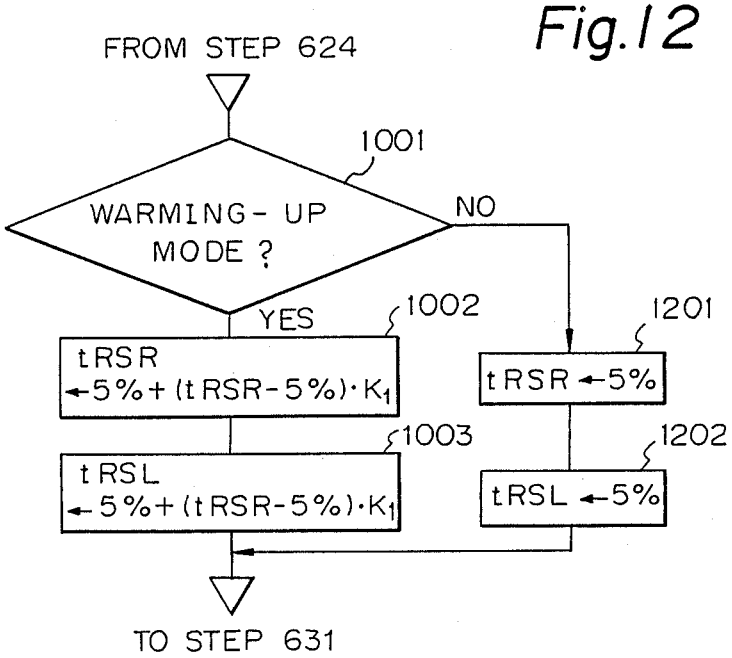
Figure 11:
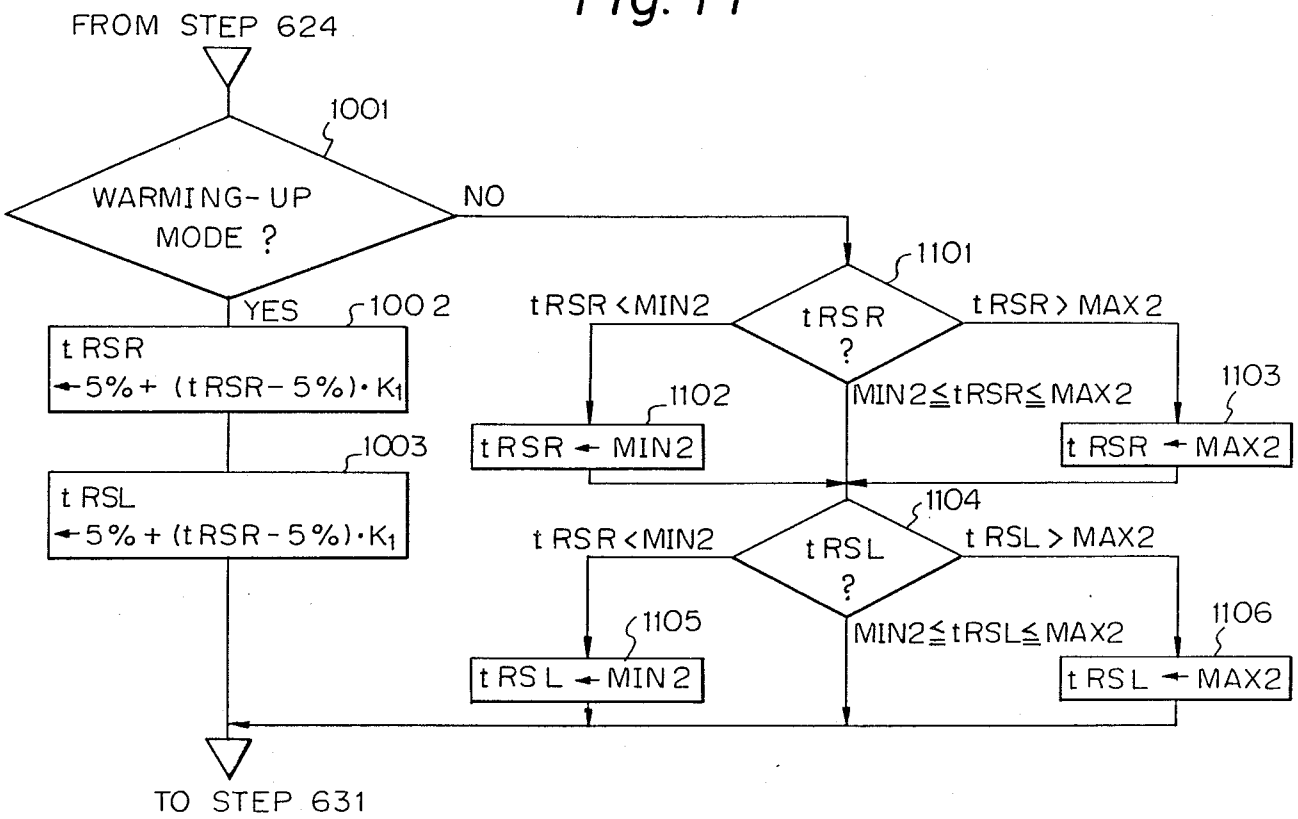

In FIGS. 10, 11, and 12, which are also modifications of FIG. 6, in an open-loop control mode for the downstream-side $O_2$ sensor 15, the allowable range (the control range) is variable in accordance with whether or not a driving operation such as a warming-up mode and an idling state. For example, when the engine is in the warming-up mode (i.e., when the determination at step 1001 is affirmative), the control range Δ is reduced by $K_1$ (FIGS. 10, 11, and 12), while when the engine is in a non-warming-up mode (i.e., when the determination at step 1001 is negative), the control range Δ is reduced by $K_2$ ($<K_1$) (see: steps 1003 and 1004 of FIG. 10). Alternately, the control range Δ is within a range from MIN2 to MAX2 (see: steps 1101 to 1106 of FIG. 11, or the skip amounts tRSR and tRSL are fixed values such as 5% (see steps 1201 and 1202 of FIG. 12). According to the routines of FIGS. 10, 11, and 12, the values tRSR and tRSL can be modified to avoid the smells of for example, hydrogen sulfide, from the catalyst converter 12.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 701 of FIG. 7 is determined by the carburetor itself, i.e., the intake air negative pressure and the engine speed, and the air amount corresponding to TAU at step 703 of FIG. 7.

Further, a CO sensor, a lean-mixture sensor or the like can be also used instead of the $O_2$ sensor.

I claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether or not said engine is in an air-fuel ratio feedback control mode for said downstream-side air-fuel ratio sensor;

calculating an air-fuel ratio feedback control parameter in accordance with the output of said downstream-side air-fuel ratio sensor when said engine is in said air-fuel ratio feedback control mode;

storing said air-fuel ratio feedback control parameter;

increasing an allowable range of said air-fuel ratio feedback control parameter when said engine is in said air-fuel ratio feedback control mode to an allowable range larger than when said engine is not in said air-fuel ratio feedback control mode;

imposing said allowable range on said stored air-fuel ratio feedback control parameter; and adjusting an actual air-fuel ratio in accordance with the output of said upstream-side air-fuel ratio sensor and said imposed air-fuel ratio feedback control parameter.

2. A method as set forth in claim 1, wherein said allowable range increasing step comprises the steps of:

setting a first predetermined allowable range in said allowable range when said engine is in said air-fuel ratio feedback control mode; and setting a second predetermined allowable range in said allowable range by reducing said first predetermined allowable range by a predetermined ratio to the center thereof when said engine is not in said air-fuel ratio feedback control mode.

3. A method as set forth in claim 2, wherein said predetermined ratio is variable in accordance with a driving parameter of said engine.

4. A method as set forth in claim 1, wherein said allowable range increasing step comprises the steps of:

setting a first predetermined allowable range in said allowable range when said engine is in said air-fuel ratio feedback control mode;

determining whether or not said engine is in a warming-up mode;

setting a second predetermined allowable range in said allowable range by reducing said first predetermined allowable range by a predetermined ratio to the center thereof, when said engine is not in said air-fuel ratio feedback control mode and is in said warming-up mode; and setting a third predetermined allowable range smaller than said first predetermined allowable range in said allowable range when said engine is in said air-fuel ratio feedback control mode and is not in said warming-up mode.

5. A method as set forth in claim 4, wherein said predetermined ratio is variable in accordance with a driving parameter of said engine.

6. A method as set forth in claim 1, wherein said allowable range increasing step comprises the steps of:

setting a first predetermined allowable range in said allowable range when said engine is in said air-fuel ratio feedback control mode;

determining whether or not said engine is in a warming-up mode;

setting a second predetermined allowable range in said allowable range by reducing said first predetermined allowable range by a predetermined ratio to the center thereof, when said engine is not in said air-fuel ratio feedback control mode and is in said warming-up mode; and setting a fixed value in said allowable range when said engine is in said air-fuel ratio feedback control mode and is not in said warming-up mode.

7. A method as set forth in claim 1, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

8. A method as set forth in claim 1, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

9. A method as set forth in claim 1, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

10. A method as set forth in claim 1, wherein said air-fuel ratio feedback control parameter is determined by a reference voltage with which the output of said upstream-side air-fuel ratio sensor is compared, thereby determining whether the air-fuel ratio is on the rich side or on the lean side.

11. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether or not said engine is in an air-fuel ratio feedback control mode for said downstream-side air-fuel ratio sensor;

means for calculating an air-fuel ratio feedback control parameter in accordance with the output of said downstream-side air-fuel ratio sensor when said engine is in said air-fuel ratio feedback control mode;

means for storing said air-fuel ratio feedback control parameter;

means for increasing an allowable range of said air-fuel ratio feedback control parameter when said engine is in said air-fuel ratio feedback control mode to an allowable range larger than when said engine is not in said air-fuel ratio feedback control mode;

means for imposing said allowable range on said stored air-fuel ratio feedback control parameter; and means for adjusting an actual air-fuel ratio in accordance with the output of said upstream-side air-fuel ratio sensor and said imposed air-fuel ratio feedback control parameter.

12. An apparatus as set forth in claim 11, wherein said allowable range increasing means comprises:

means for setting a first predetermined allowable range in said allowable range when said engine is in said air-fuel ratio feedback control mode; and means for setting a second predetermined allowable range in said allowable range by reducing said first predetermined allowable range by a predetermined ratio to the center thereof when said engine is not in said air-fuel ratio feedback control mode.

13. An apparatus as set forth in claim 12, wherein said predetermined ratio is variable in accordance with a driving parameter of said engine.

14. An apparatus as set forth in claim 11, wherein said allowable range increasing means comprises:

means for setting a first predetermined allowable range in said allowable range when said engine is in said air-fuel ratio feedback control mode;

means for determining whether or not said engine is in a warming-up mode;

means for setting a second predetermined allowable range in said allowable range by reducing said first predetermined allowable range by a predetermined ratio to the center thereof, when said engine is not in said air-fuel ratio feedback control mode and is in said warming-up mode; and means for setting a third predetermined allowable range smaller than said first predetermined allowable range in said allowable range when said engine is in said air-fuel ratio feedback control mode and is not in said warming-up mode.

15. An apparatus as set forth in claim 14, wherein said predetermined ratio is variable in accordance with a driving parameter of said engine.

16. An apparatus as set forth in claim 11, wherein said allowable range increasing means comprises:

means for setting a first predetermined allowable range in said allowable range when said engine is in said air-fuel ratio feedback control mode;

means for determining whether or not said engine is in a warming-up mode;

means for setting a second predetermined allowable range in said allowable range by reducing said first predetermined allowable range by a predetermined ratio to the center thereof, when said engine is not in said air-fuel ratio feedback control mode and is in said warming-up mode; and means for setting a fixed value in said allowable range when said engine is in said air-fuel ratio feedback control mode and is not in said warming-up mode.

17. A method as set forth in claim 11, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

18. A method as set forth in claim 11, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

19. A method as set forth in claim 11, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

20. A method as set forth in claim 11, wherein said air-fuel ratio feedback control parameter is determined by a reference voltage with which the output of said upstream-side air-fuel ratio sensor is compared, thereby determining whether the air-fuel ratio is on the rich side or on the lean side.

* * * * *